US005133811A

United States Patent [19]

Kirkwood et al.

[11] Patent Number: 5,133,811

[45] Date of Patent: Jul. 28, 1992

[54] THIXOTROPIC MATERIALS

[75] Inventors: David H. Kirkwood; Christopher M. Sellars, both of Sheffield, United Kingdom; Luis G. E. Boyed, Guadalajara, Mexico

[73] Assignee: University of Sheffield, Sheffield, United Kingdom

[21] Appl. No.: 271,757

[22] PCT Filed: May 12, 1987

[86] PCT No.: PCT/GB87/00321

§ 371 Date: Jan. 3, 1989

§ 102(e) Date: Jan. 3, 1989

[87] PCT Pub. No.: WO87/06957

PCT Pub. Date: Nov. 19, 1987

[30] Foreign Application Priority Data

May 12, 1986 [GB] United Kingdom ..... 8611563
Mar. 5, 1987 [GB] United Kingdom ..... 8705104

[51] Int. Cl.[5] ..... C22F 1/00

[52] U.S. Cl. ..... 148/95; 148/542; 148/550; 148/552

[58] Field of Search ..... 148/11.5 R, 2, 3, 4, 148/1, 11.5 A, 12 R, 12 E, 12 EA; 164/138, 520; 72/462, 372, 377

[56] References Cited

U.S. PATENT DOCUMENTS 3,948,650 4/1976 Flemings ..... 75/135
3,954,455 5/1976 Flemings ..... 75/134 R
4,295,896 10/1991 Flemings et al. ..... 148/4

FOREIGN PATENT DOCUMENTS 0090253 10/1983 European Pat. Off. .
0139168 8/1984 European Pat. Off. .
1400624 7/1975 United Kingdom .
1499934 2/1978 United Kingdom .
1502114 2/1978 United Kingdom .

*Primary Examiner*—R. Dean
*Attorney, Agent, or Firm*—Brown, Martin, Haller & McClain

[57] ABSTRACT

A method of producing a thixotropic material is provided which consists of deforming a fully solidified metal or metal alloy below its temperature of recrystallization by cold or warm working such as extrusion or rolling. The deformed material is then caused to recrystallize by heating and the temperature is either further raised or subsequently raised above the solidus of the material so that the recrystallized structure partially melts to provide discrete particles which spheroidize in the liquid matrix to provide a material which behaves thixotropically. The flow characteristics of the material are such that lower forming loads are required and weaker non-metallic die materials may be used.

8 Claims, 9 Drawing Sheets

THIXOTROPIC MATERIALS

This invention relates to the manufacture of improved thixotropic materials and to an improved method and apparatus for casting and forging thixotropic material.

The formation of metal slurries comprised of degenerate dendritic or nodular discrete solid particles within a liquid matrix and which exhibit thixotropic properties is well known, for example from U.S. Pat. Nos. 3,948,650 and 3,954,455, and UK Patent 1400624. All these patents refer to the production of such slurries by means of the vigorous agitation of the melt during solidification. However, physical agitation of a melt becomes more and more difficult as the melt approaches solidification. An improved process is disclosed in European published Applications 0090253 and 0139168 where a process for the preparation of a metal composition for forming in a partially solid, partially liquid condition is disclosed. The process comprises hot working the metal composition between the recrystallization temperature and the solidus temperature and introducing a critical level of strain either concurrently with or as a separate step subsequent to hot working. Upon completion of the hot working and any required cold working, the metal composition is reheated to a temperature above the solidus and below the liquidus.

Whilst such a process is an improvement over the earlier arrangements it still requires several process steps and an object of the present invention is to provide a simplified process which achieves a composition suitable for forming in a partially solid, partially liquid, or thixotropic condition.

According to the present invention there is provided a method of producing a thixotropic material comprising the steps of deforming a fully solidified metal or metal alloy material below its temperature of recrystallisation, heating the deformed material to cause recrystallisation of the microstructure of the material, and raising the temperature of the material above its solidus temperature whereby the recrystallised structure partially melts to provide discrete particles in a liquid matrix which behaves thixotropically.

The discrete solid particles in the liquid matrix will rapidly spheroidise under surface tension forces to produce a dispersion of near round solid particles.

The deformation and recrystallisation steps are carried out sequentially with cold or warm working being followed by heating to effect recrystallisation. Suitably the working is extrusion or rolling. In this specification by 'warm working' we mean working conducted at a temperature between room temperature and the temperature of recrystallisation for the material being worked.

The preferred starting-material in the method of production is a fully solidified alloy which may or may not have initially a dendritic microstructure. The starting material may be deformed by some suitable means such as by extrusion, rolling, tensile extension or compression. The deformation may be performed at low temperatures but to such an extent that, on raising the temperature, recrystallisation of the structure occurs.

The subsequent step of raising the temperature allows partial melting of the alloy. This melting will start normally in the lowest melting point regions which were the last to solidify in the original casting and comprise regions at the grain boundaries and between dendrite arms where microsegregation has occurred. In most cases high angle grain boundaries introduced by the recrystallisation process will also melt causing each grain to separate as a discrete solid particle within the matrix liquid. Even where the boundaries are not completely wetted by the liquid phase (i.e. melted), a groove will be established down the grain boundary at the liquid/solid interface such that the surface tension forces are locally balanced. With fine enough microstructures these grooves may be deep enough to cause fragmentation of the solid into small discrete particles surrounded by matrix liquid.

The recrystallisation and melting steps of the present invention can occur successively in the same heating operation or may be separate stages of production. In either case the discrete particles produced on partial melting will rapidly spheroidise under surface tension forces to produce a dispersion of near round solid particles within the melt. Such a semi-solid/semi-liquid slurry behaves as a thioxotropic material and may be formed, cast or forged to any required shape. If desired the material may be cooled and then reheated to a temperature between its solididus and liquidus temperatures to regain its thixotropic properties.

An advantage of a material which exhibits thixotropic properties between its solidus and liquidus temperatures is that it can be formed, for example cast or forged, under reduced loads.

For example the U.S. Pat. Nos. 3,948,650 and 3,954,455 mentioned above refer to the use of thixotropic metal slurries in shape forming operations. In particular they refer to closed die forging which traditionally takes place with hot solid metal between alloy steel dies using very high forging stresses (100 MPa). In conventional die forging the dies are extremely expensive to make and rapidly lose their shape and dimensions owing to wear and distortion. This leads in turn to poorer dimensional accuracy of the forging.

The fact that thixotropic metal slurries produced by processes such as agitation during solidification, and the method of the present invention (recrystallisation followed by partial melting), flow under very low shear stresses (typically ~1.5 MPa for steels) means that during closed die forging of such material, the die itself is subjected to relatively low stresses.

Therefore, according to another aspect of this invention we propose a die for forming thixotropic material comprising mechanically weaker die material than conventionally employed, and in particular non-metallic materials which may be easily and cheaply fabricated. Examples of the materials that may be employed are graphite, a moulding ceramic and machinable ceramics such as pyrophyllite. These materials have the additional advantage of possessing lower thermal diffusivity (or better insulation) than metallic dies so that the thixotropic slurry will not solidify too rapidly but is allowed to take the form of the die before becoming too 'stiff' to flow so that better product resolution is achieved.

The dies of the present invention may be used with the thixotropic material produced by the method herein or with any other thixotropic material. Thus, the invention also includes an improved method for producing a metal or metal alloy product comprising the steps of:

(a) providing a material which behaves thixotropically above its solidus; and (b) casting, forging, or extruding the thixotropic material above its solidus employing a die comprising a body of non-metallic material.

Step (a) may comprise for example:

(c) deforming a fully solidified metal or metal alloy material below its temperature of recrystallisation;

(d) heating the deformed material to cause recrystallisation of the microstructure of the material; and (e) raising the temperature of the material above its solidus temperature whereby the recrystallised structure partially melts to provide discrete particles in a liquid matrix which behaves thixotropically.

In thixoforging and thixoextruding the load conditions may be considerably reduced over conventional forging methods.

Step (b) may be conducted whilst the material is maintained at its elevated temperature or the thixotropic state of the material may be regained by subsequent reheating.

The invention will now be described by way of example with reference to the accompanying photomicrographs in which.

Figure 1A:
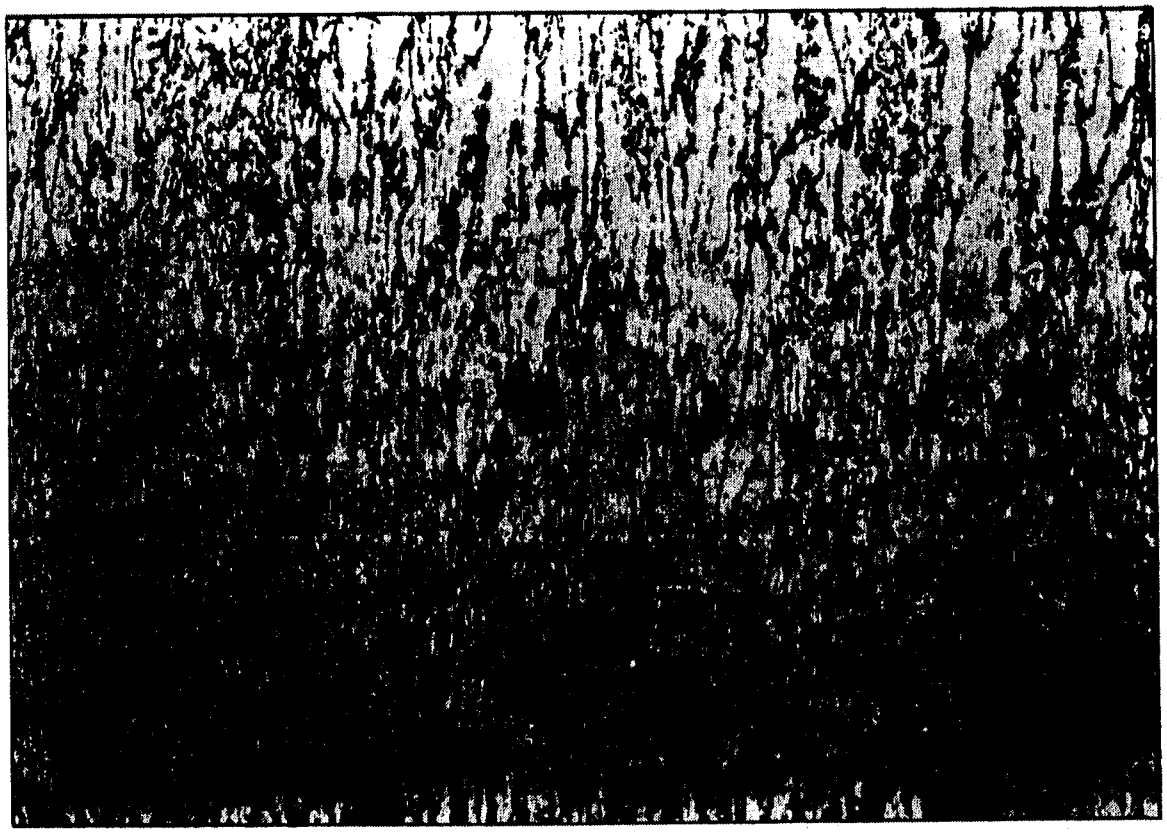
FIG. 1A is conventionally cast and extruded Al-6 wt % Si ×80 magnification.
Figure 1B:
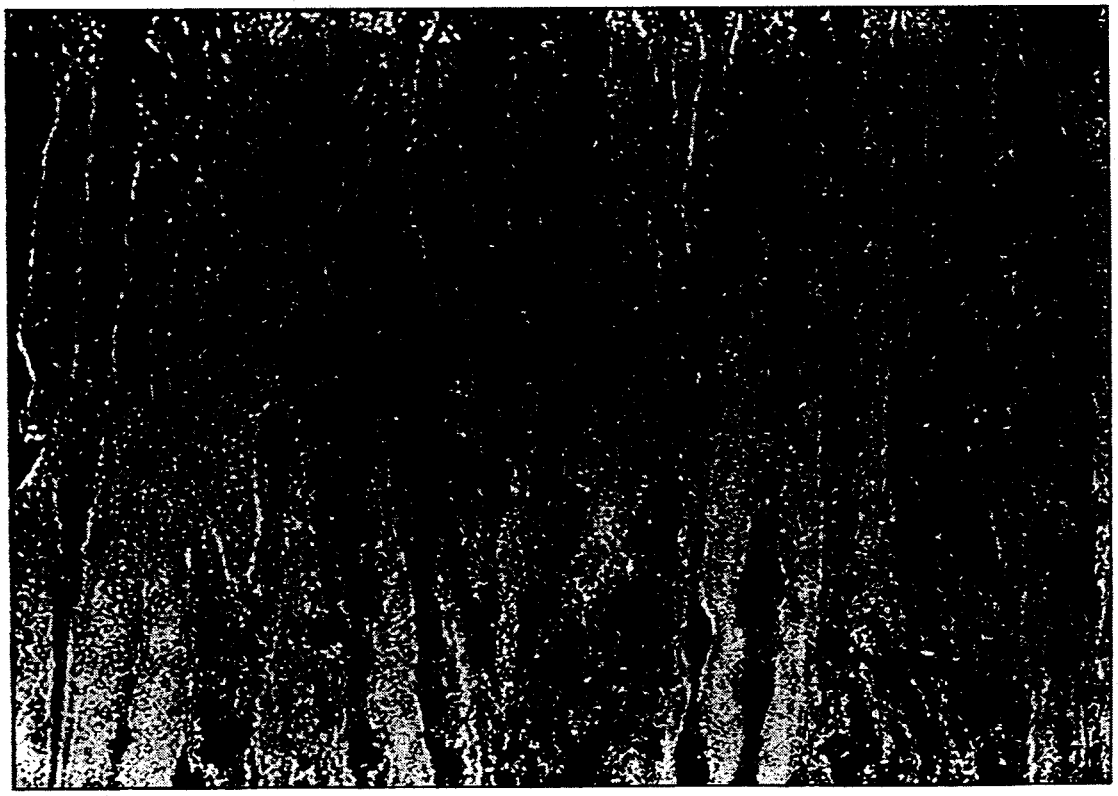
FIG. 1B is the cast and extruded material of FIG. 1A etched to show the grain boundaries prior to recrystallisation ×250 magnification.
Figure 2:
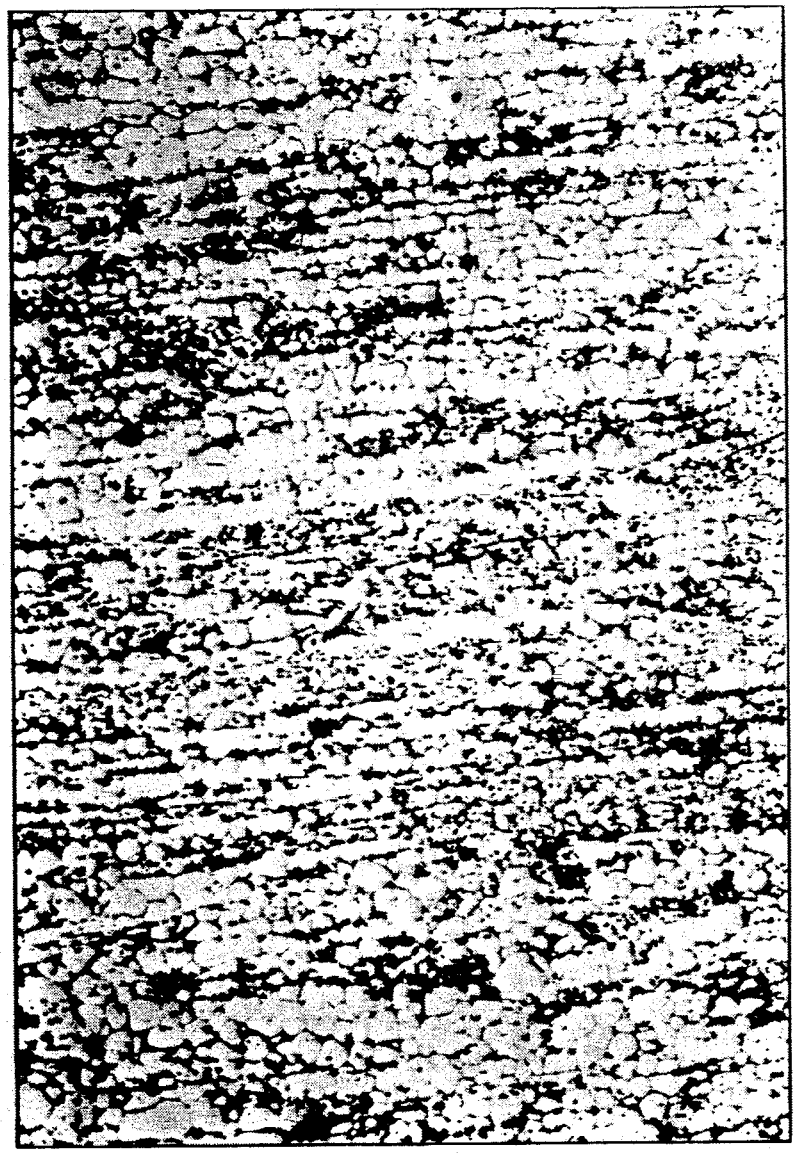
FIG. 2 is the material of FIG. 1 recrystallised and partially melted in accordance with the invention ×80 magnification.
Figure 3:
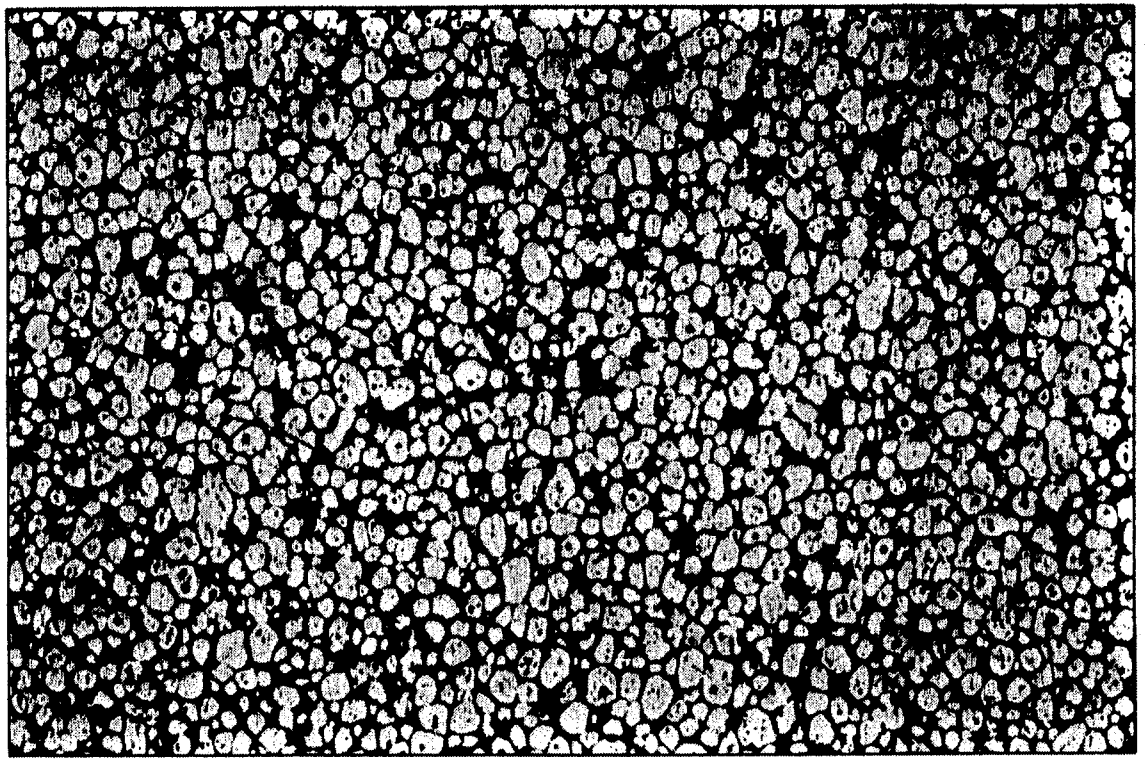
FIG. 3 is the final structure of the recrystallised and partially melted material in accordance with the invention ×80 magnification.
Figure 4:
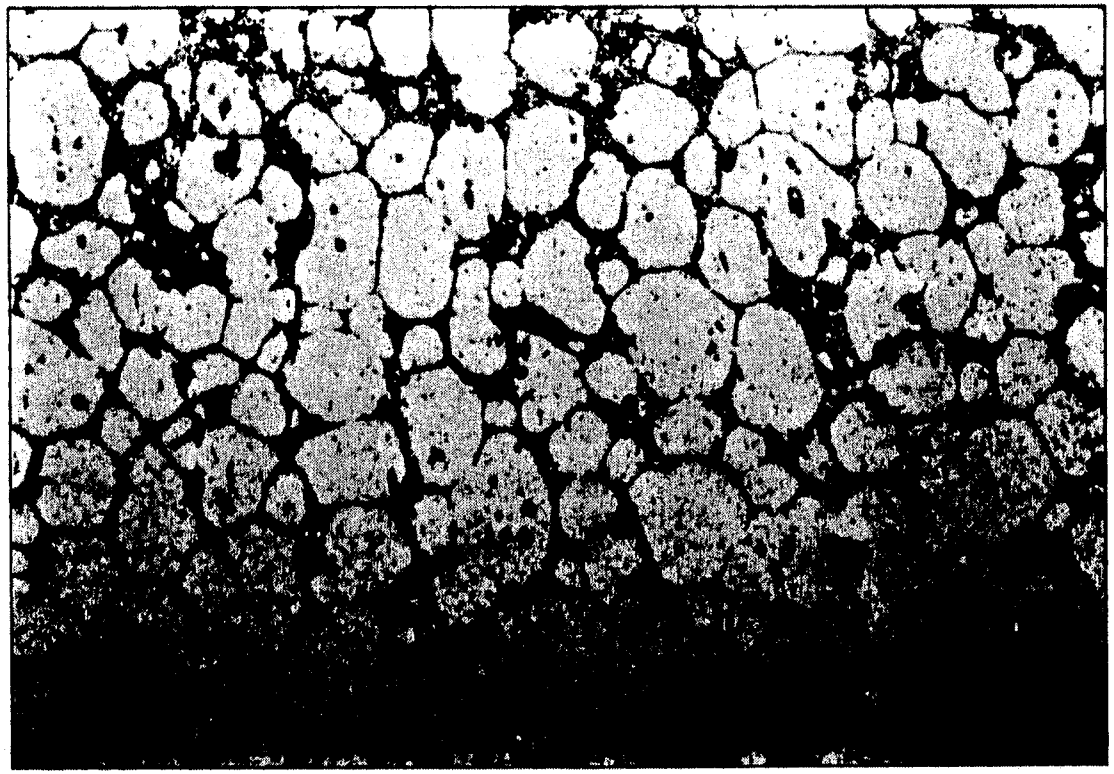
FIG. 4 shows the structure of FIG. 3 ×300 magnification.

With reference to the FIGS. 1 to 4 an example of how a thixotropic metal slurry may be produced by the method of recrystallisation and partial melting in accordance with the invention is given by an alloy of aluminium containing 6 wt % silicon. The starting material, which has been cast as a 73 mm diameter cylindrical ingot and extruded below the recrystallisation temperature at 300° C. down to 32 mm diameter, giving a strain of 1.65, has a structure as shown in FIGS. 1A and 1B with grains deformed due to the working performed on it. It will be seen from examination of FIGS. 1A and particularly 1B that substantially no recrystallisation of the grains has taken place during the extrusion process. The alloy is then heated to a temperature of around 600° C. (just above the eutectic temperature of 577° C.) in around 6 minutes. In the process of heating, recrystallisation will occur above 300° C. to form new small grains throughout the structure replacing the original deformed grains. Then, partial melting above the eutectic temperature (577° C.), liquid forms in the eutectic regions and penetrates the grain boundaries of the primary aluminium phase causing fragmentation of the grains into small discrete spheroidal solid particles within the liquid phase. The actual structure of the material with the new grain formation can be seen from examination of FIGS. 2 to 4 where FIG. 2 shows the microstructure at the initial stages of melting, and FIG. 3 and 4 show the final partially melted microstructure of spheroidal particles, which is achieved in about 1 minute after the initial melting. The final microstructure exhibits good thixotropic properties and may be readily thixocast or thixoforged.

Figure 5:
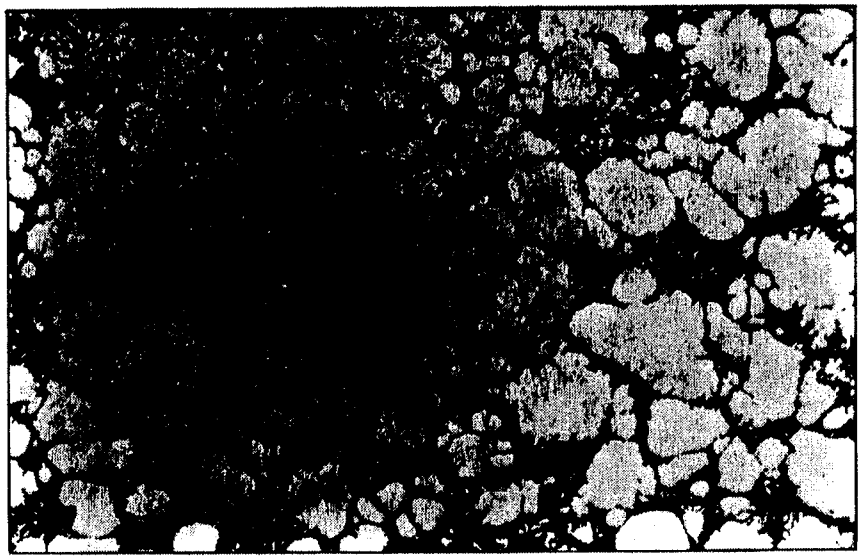
FIG. 5 is the structure of conventional rheocast Al-6 wt % Si, stirred at 279 $s^{-1}$ before quenching ×80 magnification.

Recrystallisation is a process which occurs with heating a worked material and a critical strain (of about 0.05 depending on the alloy system) is required before recrystallisation can occur. Increasing strain above this value causes both the recrystallised grain size and the particle size in the final slurry to decrease. In the present example the strain of 1.65 gave a particle size of 30 μm and fine particles sizes in the range 20–30 μm are easily obtained. This is much smaller than that typically achieved by the conventional stir cast rheocasting process which in FIG. 5 is about 130 μm with the particles clearly less rounded than with the present invention. The particles in FIGS. 3 and 4 also have a smaller spread in size distribution.

The fine particle size achieved by the process of the invention could have important consequences for the heat treatment and mechanical properties of the forged product. Fine structures enable both non equilibrium second phase precipitates to dissolve into the matrix (solutionizing) and homogenisation of the matrix to be achieved more completely. On subsequent ageing of the alloy, fine uniformly distributed precipitates may be induced to form and these microstructures can be expected to possess good mechanical properties.

The particle size will be a function of the grain size before incipient melting begins. This may be coarse either because of insufficient deformation of the alloy prior to recrystallisation, or it may be that grain growth is so rapid that large grains are formed. Certainly the ideal situation and therefore the preferred method for producing a fine particle slurry is for incipient melting to occur as rapidly as possible after recrystallisation i.e.: the rapid reheating of previously 'cold' or 'warm' deformed material.

Figure 6:
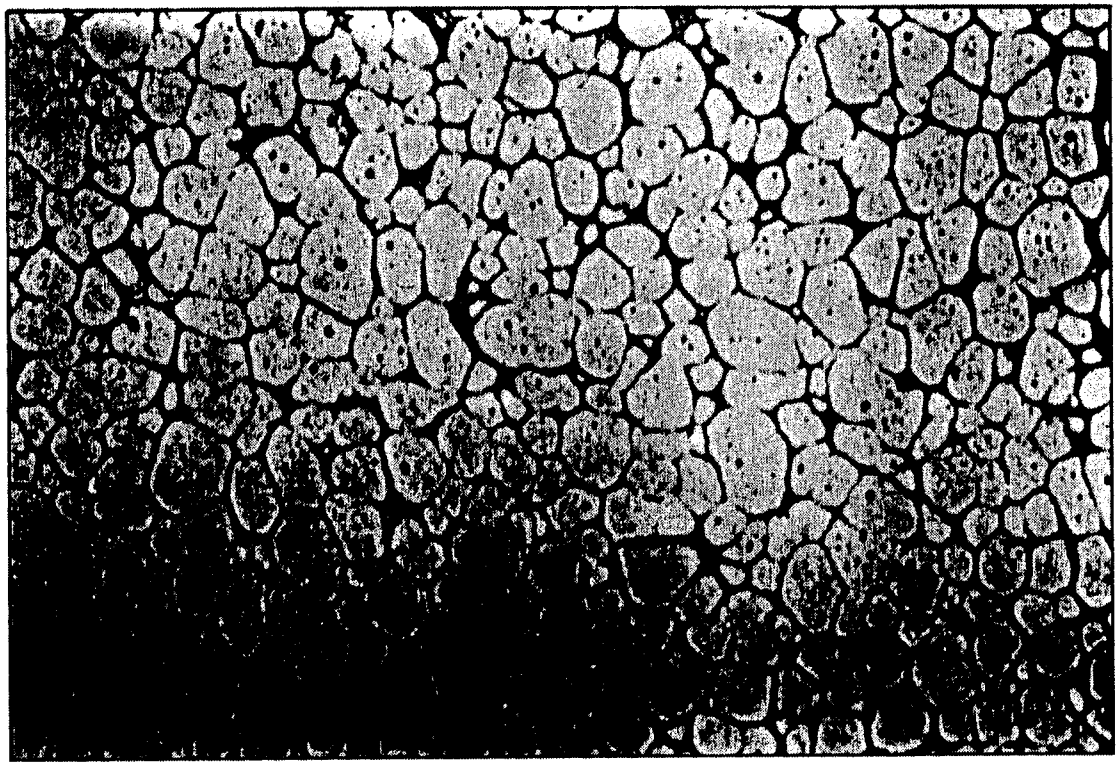
FIG. 6 shows AISI grade 440c stainless steel, extruded recrystallised and partially melted in accordance with the invention ×80 magnification showing non dendritic primary particles.

FIG. 6 shows the present invention as applied to 440C stainless steel. It will be seen that the results are similar to the results shown in FIG. 3 except that the grain size is coarser.

Figure 8:
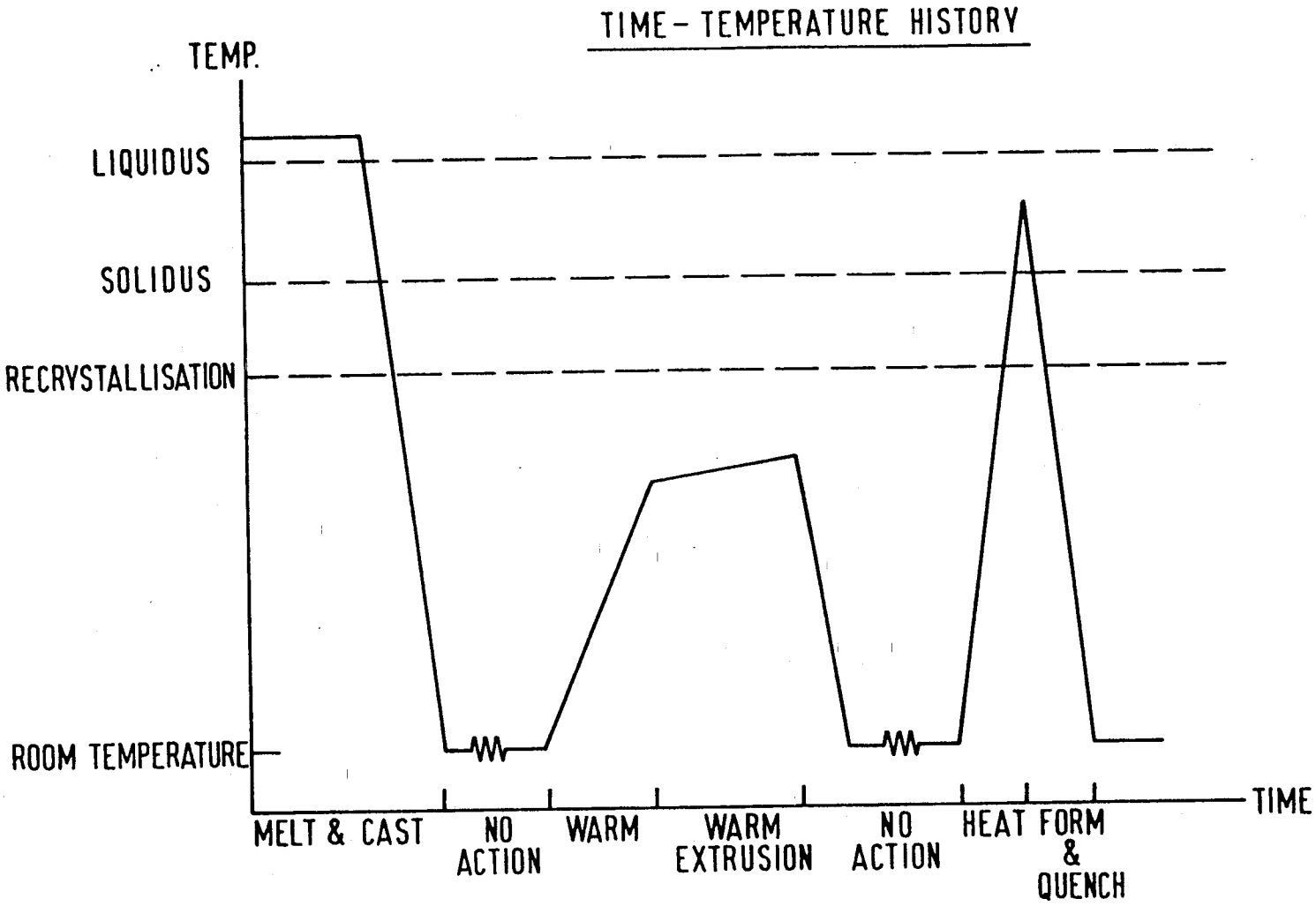
FIG. 8 is a diagrammatic time-temperature history showing the process steps of the present invention.

The process of the present invention is illustrated by the profile of the process shown diagrammatically in FIG. 8 where the material is deformed by warm extrusion. From that figure it will be seen that the process only requires deformation below the temperature of recrystallisation and subsequent heating through the temperature of recrystallisation to a temperature just above the solidus so that the desired thixotropic material is achieved.

The flow characteristics of a thixotropic material mean that the use of weaker die materials has been found to be possible. By way of example a graphite die was machined to shape and a ceramic die produced from a pattern by a moulding technique called the 'Shaw' process. Both types of die were enclosed within a metal casting to support the hoop stresses generated while the thixotropic slurry was still in the fluid state. Forgings made from aluminium alloy and high speed tool steel thixotropic slurries in the graphite dies gave excellent reproduction and aluminium slurries thixoforged into a moulded ceramic die was also successful.

The use of relatively weak non-metallic dies, is a significant departure from traditional techniques since all previous work on thixoforging, which, in any event, is not a widely known process, has involved the use of conventional die steels (which are expensive) in conventional hydraulic forging presses capable of loads in excess of 50 tons. The pressure generated on the forging itself are ~100 MPa or greater as in conventional forging, and under these conditions mechanically strong dies are probably essential. However, with metal dies, in order to obtain complete die filling (and avoid premature solidification) the dies needed to be preheated.

As a result of our original observation that such high pressures were not necessary to cause the thixotropic metal slurry to flow into the die we decided to use a pneumatic press, capable of a maximum load of only 2.5 ton, developing a final pressure of 10 MPa on our test specimens. However, premature freezing of the slurry in the metal dies prevented complete filling and good surface replication. We therefore took a further step away from conventional forging techniques by turning to using non-metallic dies because they remove the heat more slowly from the thixotropic slurry and allow better die filling. Therefore the lower stresses involved in the adoption of pneumatic press equipment permits the use of mechanically weaker, more insulating dies.

Figure 7:
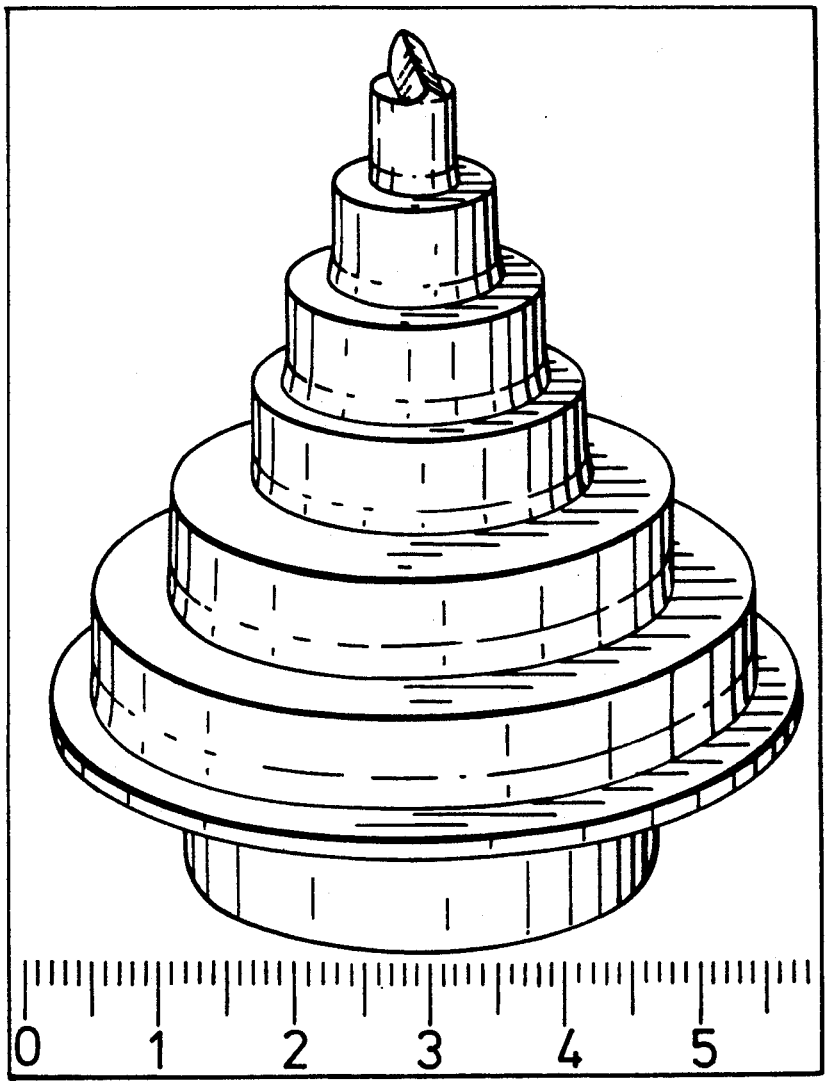
FIG. 7 is an illustration of a forging of Al-6 wt % Si thixoforged into a graphite die in accordance with the present invention.

An example of a thixoforging thixoforged within a die and with a slurry in accordance with the invention is shown in FIG. 7. This has been formed from a recrystallised and partially melted slurry of aluminium - 6 wt % silicon by forging into a graphite die under a final pressure of 12 MPa. It will be noted that the die filling and surface replication qualities are extremely good.

The benefits of thixocasting in accordance with the invention as compared with conventional die casting are, for example:

1. The alloy in the form of rheocast billets can be cut up into 'slugs' of predetermined weight in preparation for die casting thereby avoiding material waste;

2. On being reheated into the soft thixotropic state, the slug may still be handled as a solid;

3. Owing to the high viscosity of the thixotropic slurry during die-casting, the die filling occurs without turbulence avoiding air entrapment as gross voids within the casting. Accordingly, rejection of castings as unsound is reduced. Furthermore, since they may be solution treated without warping, heat treatments of alloys are possible producing enhanced mechanical properties over conventional die-casting;

4. Less heat needs to be removed for solidification within the die, consequently production rates may be higher;

5. The thermal shock imposed on the die is less, which results in a greater die life and higher melting point alloys are made available for die-casting such as aluminium bronze, stainless steels or tool steels;

6. Dies may be of simpler design, without the need for weirs or overflows and with shorter running systems so that less material waste is involved; and 7. A saving of 30% on heating costs is estimated.

Thus, in accordance with the invention a cheaper product is produced because of less waste and lower energy requirements. In addition, the thixo-casting is sounder internally leading to fewer rejections, and the mechanical properties may be enhanced if heat treatment programmes are permitted.

The benefits of thixoforging in accordance with the invention compared to conventional closed-die forging are, for example:

1. Whereas closed -die forging involves the use of presses working at very high pressures in a series of forging operations to produce the finished article, thixoforging in accordance with the invention is carried out at low pressures in a single operation. The production rates are therefore much greater and the capital costs lower;

2. The lower operation pressures possible with the present invention mean that either damage to expensive dies is reduced and their lives extended or cheaper die materials may be used. It also means that forging is more accurate and dimensional tolerances better, resulting in the reduction or elimination of finishing costs (e.g. machining costs); and 3. Alloys which could not be forged or extruded in the past (certain stainless steels and high speed tool steels) may be amenable to thixoforging between closed dies (and thixoextruding).

Accordingly, the lower pressures involved in thixoforging a thixotropic material produced in accordance with the invention are likely to reduce capital costs, and the improved dimensional tolerances of the thixoforged product are likely to lead to reduced finishing costs.

We claim:

1. A method of producing a thixotropic material comprising the steps of deforming a fully solidified metal or metal alloy material below its temperature of recrystallisation, heating the deformed material to cause recrystallisation of the microstructure of the material, and raising the temperature of the material above its solidus temperature whereby the recrystallised structure partially melts to provide discrete particles in a liquid matrix which behaves thixotropically.

2. A method according to claim 1 wherein the deformation comprises cold or warm working.

3. A method according to claim 2 wherein the working is extrusion or rolling.

4. A method according to claim 1 wherein the recrystallisation and partial melting steps occur successively in the same heating operation.

5. A method according to claim 1 wherein the fully solidified material is extruded to give the necessary strain for recrystallisation, the deformed material is heated above its recrystallisation temperature to form new small grains, and heating is continued to just above solidus so that partial melting occurs causing the solid grains to fragment and spheroidise within the liquid phase whereby a thixotropic material is produced.

6. A method for producing a metal or metal alloy product comprising the steps of (a) providing a meterial which behaves thixotropically above its solidus by:

(b) deforming a fully solidified metal or metal alloy material below its temperature of recrystallisation;

(c) heating the deformed material to cause recrystallisation of the microstructure of the material;

(d) raising the temperature of the material above its solidus temperature whereby the recrystallised structure partially melts to provide discrete particles in a liquid matrix which behaves thixotropically; and (e) casting, forging, or extruding the thixotropic material above its solidus within a die comprising a body of non-metallic material.

7. A method according to claim 6 wherein step (e) is conducted whilst the material is maintained at its elevated temperature.

8. A method according to claim 6 wherein the material is formed with a reduced load developing a final pressure of the order of 10 to 12 Mpa.

* * * * *

UNITED STATES PATENT AND TRADEMARK OFFICE

CERTIFICATE OF CORRECTION

PATENT NO. : 5,133,811

DATED : July 28, 1992

INVENTOR(S) : DAVID H. KIRKWOOD, ET AL.

It is certified that error appears in the above-identified patent and that said Letters Patent is hereby corrected as shown below:

On the title page, item [75], delete "Luis G. E. Boyed" and insert --Luis G. Elias Boyed--

Signed and Sealed this

Second Day of November, 1993

*Attest:*

Bruce Lehman

BRUCE LEHMAN

*Attesting Officer*

*Commissioner of Patents and Trademarks*